US006935056B2

(12) United States Patent
Milanese

(10) Patent No.: US 6,935,056 B2
(45) Date of Patent: Aug. 30, 2005

(54) STEAM IRON WITH STEAM CHAMBER WITH A SMALL-SIZED VENT

(75) Inventor: Pierantonio Milanese, Susegana (IT)

(73) Assignee: Euroflex S.r.l., Susegana (TV) (IT)

( * ) Notice: Subject to any disclaimer, the term of this patent is extended or adjusted under 35 U.S.C. 154(b) by 0 days.

(21) Appl. No.: 10/401,286

(22) Filed: Mar. 27, 2003

(65) Prior Publication Data

US 2003/0221342 A1 Dec. 4, 2003

(30) Foreign Application Priority Data

Mar. 27, 2002 (IT) ..... PD2002A0078
Mar. 14, 2003 (IT) ..... PD2003A0051

(51) Int. Cl.[7] ..... D06F 75/08; D06F 75/24

(52) U.S. Cl. ..... 38/77.5; 38/77.6; 38/77.7; 38/77.83

(58) Field of Search ..... 38/77.3, 77.1, 38/77.5, 77.6, 77.81, 77.83, 84, 85

(56) References Cited

U.S. PATENT DOCUMENTS 1,328,766 A * 1/1920 Rubenstein ..... 38/77.6
2,021,606 A * 11/1935 Mitzman ..... 38/77.6
2,384,839 A * 9/1945 Kistner ..... 38/77.7
3,002,302 A * 10/1961 Flowers ..... 38/77.5
3,823,497 A * 7/1974 Solomon ..... 38/77.6
5,279,055 A * 1/1994 Eckert et al. ..... 38/77.83
5,704,143 A * 1/1998 Kubicz ..... 38/77.83

* cited by examiner

*Primary Examiner*—Ismael Izaguirre
(74) *Attorney, Agent, or Firm*—Harrison & Egbert

(57) ABSTRACT

A new steam iron with a steam chamber connected with the labyrinths and the steam outlet vents of the soleplate through a small connection duct or a small hole, in such a way as to keep high pressure inside the steam generation chamber. The iron is provided with a steam spray positioned at the front and directed towards its point.

8 Claims, 4 Drawing Sheets

STEAM IRON WITH STEAM CHAMBER WITH A SMALL-SIZED VENT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

This patent concerns the field of steam irons and in particular it concerns a new steam iron having a steam generation chamber provided with a special duct to convey steam towards the outlet vents.

BACKGROUND OF THE INVENTION

Two types of steam irons are known:

cold steam irons, the so-called domestic irons, where cold water is introduced directly in the iron to generate steam;

hot steam irons, the so-called professional irons, with introduction of steam generated by a boiler.

The irons with direct introduction of cold water comprise a soleplate, provided with heating element, with a labyrinth connected to outlet vents obtained on the base of the iron itself.

Said soleplate is closed at the top by a tight cover through which cold water is introduced by means of a pump positioned on the iron or on the central unit.

The central part of the iron and the upper cover form the steam generation chamber, in which water is introduced by means of a pump and turned into steam.

The steam produced in this way goes out of the steam generation chamber, passes through the special labyrinth and is let out through the holes on the bottom of the soleplate.

During the ironing process the water fed by the pump continues to flow into the steam generation chamber, the iron and the entire steam generation chamber cool down and consequently water instead of steam flows out of the outlet vents.

Irons with steam generation in a separate boiler comprise the iron, complete with handle, and a boiler, connected with each other through a steam duct coupled with an electrical connection cable.

The boiler provides for generating steam, at the set temperature and pressure, and conveys it to the iron through the steam duct.

The iron comprises a frame with handle and an underlying soleplate, equipped with heating element, with a steam chamber connected to outlet vents obtained on the base of the iron. Said soleplate is closed at the top by a tight cover through which the steam conveyed by the duct connecting the boiler with the steam chamber is introduced in the steam chamber.

The steam introduced in the steam chamber flows out of the steam chamber and out of the holes provided on the bottom of the soleplate.

At the beginning of the ironing process the steam duct is cold and is heated by the steam that passes through it.

Both at the beginning of the ironing process and in case of long pauses between successive uses of steam, the steam that flows in the steam duct towards the iron partially cools down, and therefore partially condensates, thus reaching the iron in the form of water, and therefore the condensated water present in the steam chamber flows out of the holes provided on the soleplate.

The outlet of water from the soleplate vents is a troublesome inconvenience while ironing.

This inconvenience, besides, may cause the expulsion of limescale particles from the soleplate, particles that dirty the clothing item being ironed.

In this case it is necessary to stop ironing and wait for new steam to be produced.

Due to this type of inconvenience it is necessary to use short steam ducts, so that the temperature of the steam passing through them does not lower excessively.

To soften the fabric to be ironed, in particular in some specific points, some cold steam irons with direct steam generation are normally provided with a pump water spray that takes part of the water from the tank and sprays it externally in front of the iron. When the pump is operated, water is sprayed on the fabric in front of the iron, thus softening the fabric and ensuring better ironing of the item in difficult points or eliminating accidental creases.

Hot steam irons, instead, are not equipped with said spray, since when water reaches the iron it is already in the form of steam; if necessary, the fabric to be ironed is wet by means of independent sprays. Said independent sprays present several drawbacks, for example: they must be filled with water every time they are used, encumber the ironing area and/or are placed in uncomfortable positions around the ironing station, may be confused with size sprays, etc.

In order to eliminate all the drawbacks described above, a new type of iron has been designed and implemented, having a substantially closed steam generation chamber, that is, a steam generation chamber with a small-sized hole for the passage of steam toward the labyrinth and therefore toward the soleplate vents.

One of the main aims of the new iron is to ensure continuous steam ironing, guaranteeing the outlet of steam only from the soleplate.

Another aim of the new iron is to ensure the continuous creation of the required quantity of steam also for prolonged ironing sessions.

Another aim of the new iron is to prevent the expulsion of water and/or limescale particles through the soleplate vents.

A further aim of the new iron is to ensure that steam can be sprayed when required in front of the iron.

BRIEF SUMMARY OF THE INVENTION

These and other direct and complementary aims have been achieved through the implementation of a new steam iron both of the type with separate boiler and of the type with steam generation directly within the iron.

The new steam iron with direct steam generation has two components: the first component is the closed chamber in which steam is generated through the introduction of cold water supplied by a metering pump.

The second component consists of a hole, or preferably a duct connecting the closed generation steam chamber with the labyrinths connected with the steam outlet vents. This duct has a bottleneck or a wall with a small hole, in order to reduce the quantity of steam that flows from said steam generation chamber into said labyrinths.

Consequently, the pressure inside the steam generation chamber is higher than the pressure inside the steam generation chamber of the known types of iron.

The dimensions of the duct connecting the steam generation chamber with the labyrinths, or the dimensions of the hole in the wall, are studied so that, even if the pump operating button is pressed, the introduction of water in the steam generation chamber is limited by the pressure present in the chamber itself.

The pump, which is constantly immersed in water in order to avoid any damage to the same, does not overcome the internal pressure of the steam generation chamber, if not for the quantity of water that is turned into steam and whose steam passes through the small hole of the connection duct.

The result obtained is a balance between the head of the pump and the chamber internal pressure, which leads to an uninterrupted delivery of steam until the cold water introduced in the chamber is exhausted, even in case of very long ironing sessions.

BRIEF DESCRIPTION OF THE SEVERAL VIEWS OF THE DRAWINGS

The characteristics of the new iron will be better highlighted by the following description of one among many possible applications of the invention in question, illustrated in the attached drawings.

DETAILED DESCRIPTION OF THE INVENTION

Figure 1:
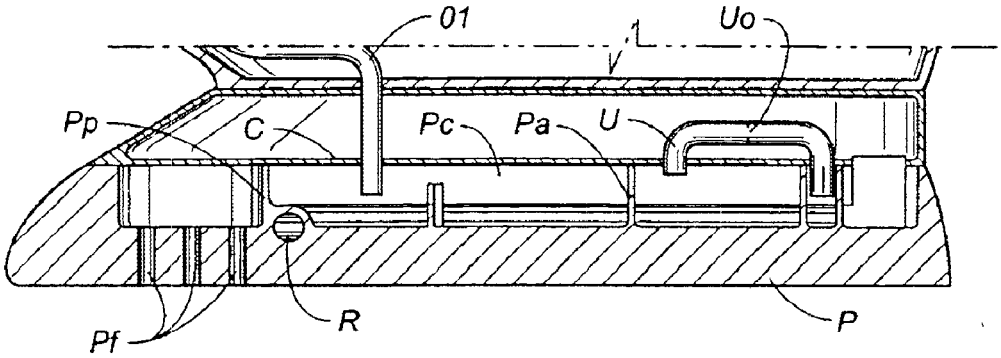
FIG. 1 shows a vertical cross section of the new iron of the present invention.
Figure 2:
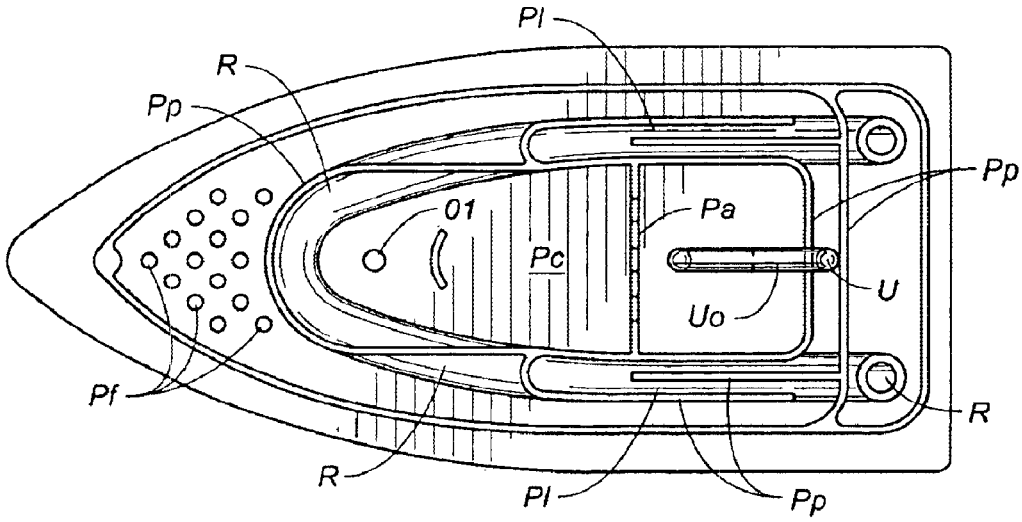
FIG. 2 shows a plan view of the soleplate (P) of the new iron.

In particular, FIG. 1 shows the soleplate (P) and the cover (C) of the iron, which covers the soleplate (P), thus creating the steam generation chamber (Pc).

The soleplate (P) of the new iron comprises an incorporated heating element (R), steam outlet vents (Pf), several walls (Pp) that form the steam generation chamber (Pc) and two labyrinths (Pl) that convey the steam towards the outlet vents (Pf).

The heating element (R) incorporated in the soleplate (P) is generically U-shaped with the ends directed toward the rear part of the soleplate (P) and protruding from the upper surface of said soleplate (P), so that they can be electrically connected.

The walls (Pp) that form the steam generation chamber (Pc) and the labyrinths (Pl) are arranged along the course of the heating element (R).

In particular, the walls (Pp) that form the steam generation chamber (Pc) are generically arranged in such a way as to form a ring or polygon and to enclose the steam generation chamber (Pc) and separate it completely from the rest of the soleplate (P).

The walls (Pp) that form the labyrinths (Pl) are arranged in the rear part of the soleplate (P) and beside the walls (Pp) that enclose the steam generation chamber (Pc).

The part (C) of the iron that covers the soleplate (P), hereinafter called simply cover (C), closes the steam generation chamber (Pc) at the top, the labyrinths (Pl) and the other areas that lead to and are above the outlet vents (Pf).

In particular, the cover (C) is crossed by the delivery duct (O1) of the water that comes from the pump has to be turned into steam and is provided with a duct (U) having the generic shape of an upturned U.

The water delivery duct (O1) introduces water in the front area of the steam generation chamber (Pc), near the curve of the heating element (R).

The upturned U-duct (U), hereinafter simply called connection duct (U), is joined to the cover (C), so that when the cover (C) is applied to the soleplate (P) one of its ends is inside the steam generation chamber (Pc) and the other end is in communication with the labyrinths (Pl) on their side opposite the outlet vents (Pf).

In particular, along said connection duct (U) there is a section with reduced inner cross section, which is obtained through a bottleneck or, preferably, through the application of a circular wall with a central hole (Uo). Both the bottleneck and the hole (Uo) of the circular wall have a small, precise internal diameter, so that the communication between the steam generation chamber (Pc) and the outside of the same, that is, the labyrinths (Pl), is limited to a predefined maximum delivery value.

As an alternative to the connection duct (U), it is possible to have a hole in the wall of the steam generation chamber (Pc) facing towards the labyrinths (Pl).

It is possible to include a partition wall (Pa) inside the steam generation chamber (Pc), between the area where the water to be converted into steam is introduced and the mouth of the connection duct (U) or the hole of the steam generation chamber (Pc), said partition wall having openings on the top.

The water is introduced in the steam generation chamber (Pc) and converted into steam.

The steam produced in this way flows through the connection duct (U) towards the labyrinths (Pl) and out of the soleplate (P) through the apposite vents (Pf).

The size of the connection duct (U) between the steam generation chamber (Pc) and the labyrinths (Pl), or of the hole in the wall, is studied so that even if the feed pump is operated continuously, only steam, never water, is sent out of the steam generation chamber (Pc).

The feed pump doesn't overcome the internal pressure of the steam generation chamber (Pc), if not for the quantity of water that is converted into steam and whose steam passes through the small-sized hole (Uo) of the connection duct (U).

In this way a limited delivery of water in the steam generation chamber is obtained and steam flows out without interruption until the cold water introduced in the chamber (Pc) is exhausted, even in case of continuous and prolonged use.

The new steam iron provided with soleplate (P) constituted as described above offers considerable advantages.

There is no interruption in the production of steam, since, even if the steam generation chamber (Pc) cools down, the water not vaporised does not block the upper connection duct (U). Said continuous production of steam is ensured also in case of long ironing sessions, since any small quantity of water passing through the connection duct (U) towards the labyrinths (Pl) is quickly turned into steam in the labyrinths (Pl) before reaching the outlet vents (Pf).

Consequently, the new iron does not send out water or limescale particles contained in the water.

The new steam iron is provided with a steam chamber that is substantially closed on all sides and equipped with a small hole or duct to convey steam towards the labyrinth and the outlet vents present on the soleplate.

The condensate present inside the steam chamber is held in said steam chamber and flows through the small delivery duct only when it has been converted into steam.

A spray is positioned at the front of the iron and is connected with the steam chamber through a duct with button valve positioned on the handle. When the valve button is pressed, the steam present inside the steam chamber is sprayed in front of the iron.

The characteristics of the new steam iron with separate boiler having the steam chamber with small-sized hole will be better highlighted by the following description of one among many possible applications of the invention in question, illustrated in the attached drawings.

Figure 1A:
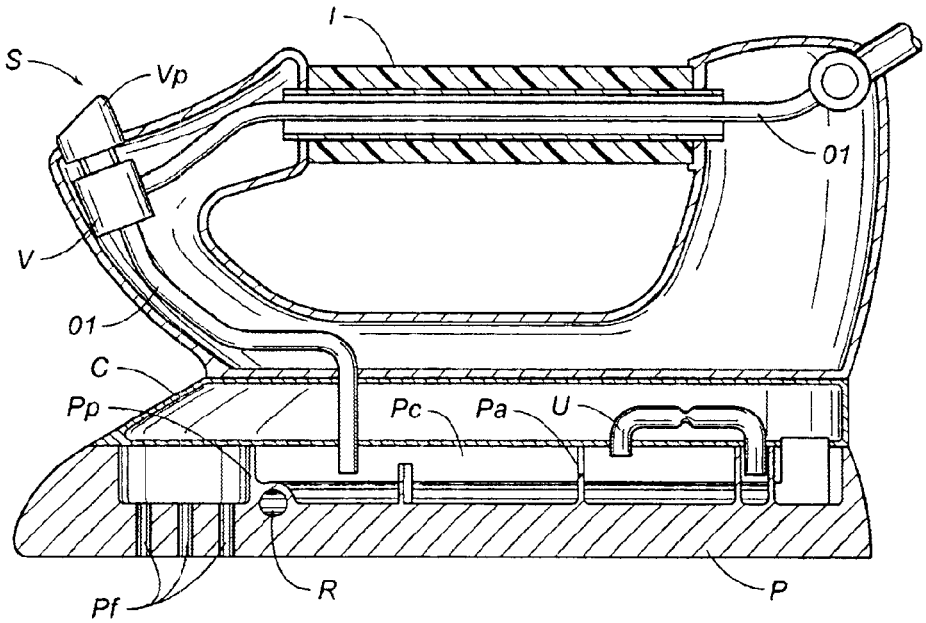
FIG. 1*a* is another vertical cross sectional view of the iron.
Figure 2A:
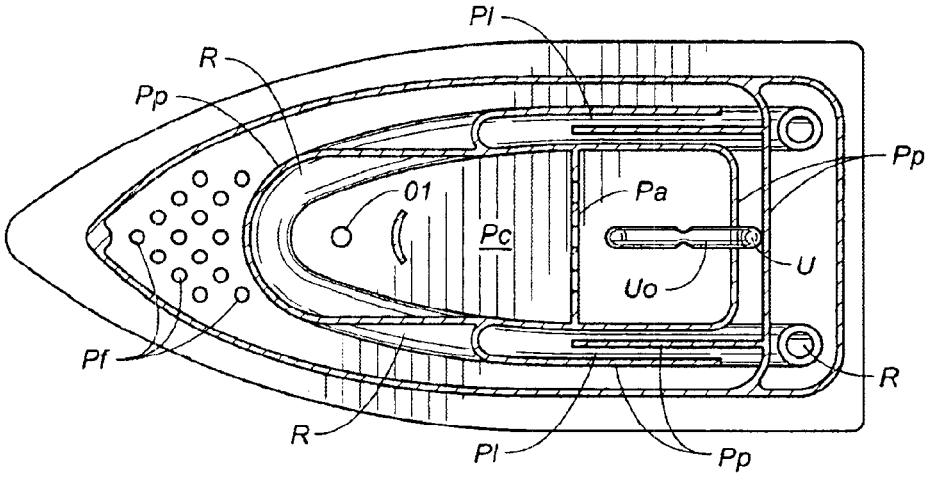
FIG. 2*a* is a horizontal cross sectional view of the iron.

FIGS. 1*a* and 2*a* show a vertical cross section and a horizontal cross section, respectively, of the iron (S), comprising a frame with handle (I), the soleplate (P) and the cover (C) of the iron, which covers said soleplate (P) forming the steam chamber (Pc).

In particular, the walls (Pp) that form the steam chamber (Pc) have a generically ring-shaped or polygonal layout, in such a way as to enclose the steam chamber (Pc) and separate it completely from the rest of the soleplate (P).

The walls (Pp) that form the labyrinths (Pl) are arranged in the rear part of the soleplate (P) and positioned besides the walls (Pp) that enclose the steam chamber (Pc).

The cover (C) is crossed by the steam delivery duct (O1) and is provided with a connection duct (U), generically shaped as an upturned U.

The duct (O1) that conveys the steam coming from the boiler (M1) of the base (M) and passing through the valve (V) controlled by the button (Vp) on the handle (I) introduces steam in the front area of the steam chamber (Pc), near the curve of the heating element (R).

The upturned U-duct (U), hereinafter simply called connection duct (U), is joined to the cover (C), so that when the cover (C) is applied to the soleplate (P) one of its ends is inside the steam chamber (Pc) and the other end is in communication with the labyrinths (Pl) on their side opposite the outlet vents (Pf).

In particular, along said connection duct (U) there is a section with reduced inner cross section, which is preferably obtained through a bottleneck (Uo), or through the application of a circular wall with central hole. Both the bottleneck (Uo) and the hole of the circular wall have reduced dimensions and are sized with precision, so that the communication between the steam chamber (Pc) and the outside of the same, that is, the labyrinths (Pl) is limited to a predefined maximum delivery value.

As an alternative to the connection duct (U), it is possible to have a hole in the wall of the steam chamber (Pc) facing towards the labyrinths (Pl).

It is possible to include a partition wall (Pa) inside the steam chamber (Pc), between the area where the water to be converted into steam is introduced and the mouth of the connection duct (U) or the hole of the steam chamber (Pc), said partition wall having openings on the top.

Steam is introduced in the steam chamber (Pc) through the relevant duct (O1) and then flows towards the labyrinths (Pl) through the connection duct (U) and out of the soleplate (P) through the appropriate vents (Pf).

The dimensions of the connection duct (U) between the steam chamber (Pc) and the labyrinths (Pl), or the dimensions of the hole in the wall, are studied so that the condensated steam, or water, coming from the delivery duct (O1) never flows out of the connection duct (U), but remains in the steam chamber (Pc) and is converted into steam.

Any further introduction of water and/or steam in the steam chamber (Pc) allows only steam to flow out through the connection duct (U), while water remains in the steam chamber (Pc) until it is turned into steam.

In this way the exclusive delivery of steam from the steam chamber (Pc) and through the vents (Pf) of the soleplate (P) is ensured.

The new steam iron provided with separate boiler constituted as described above offers considerable advantages.

There is no interruption in the production of steam, since, even if the delivery duct (O1) and/or the steam generation chamber (Pc) cool down, the condensate present in the steam chamber (Pc) does not block the upper connection duct (U).

Said continuous production of steam is ensured also in case of long steam delivery intervals, since any small quantity of water passing through the connection duct (O1) is quickly turned into steam in the steam chamber (Pc) and/or in the labyrinths (Pl) before reaching the outlet vents (Pf).

Consequently, the new iron does not send out water or limescale particles contained in water.

Figure 3:
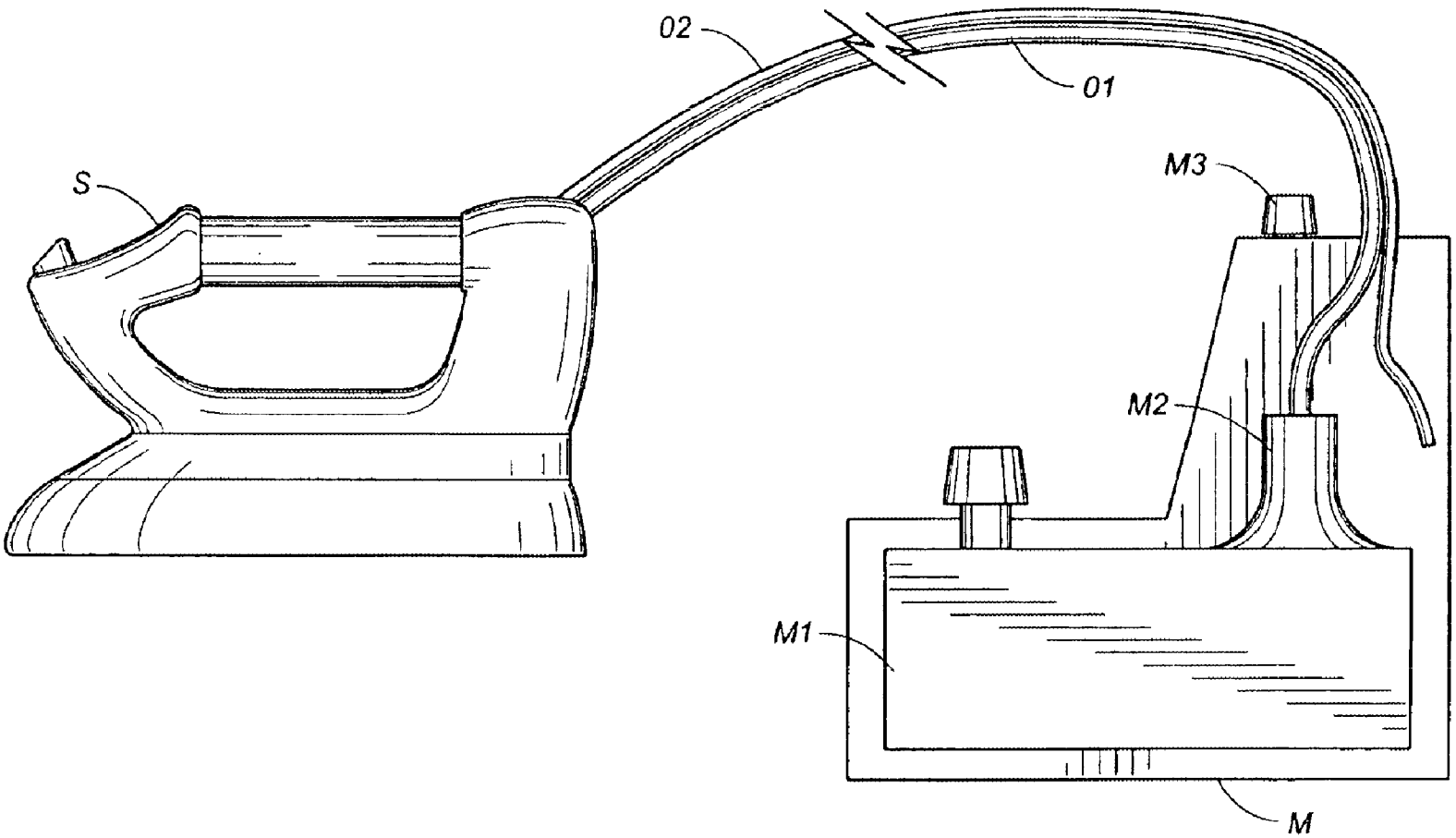
FIG. 3 is a plan view of an iron with a separate boiler.

FIG. 3 shows the new steam iron with separate boiler, comprising a base (M), an iron (S) and a steam delivery duct (O1) coupled to or positioned at the side of an electric connection cable (O2) suitable for connecting the base (M) with the iron (S).

The base (M) comprises the boiler (M1), a solenoid valve (M2) for the flow of steam in the delivery duct (O1) and various switches and knobs (M3) for switching on/off and regulating the boiler (M1).

It is possible to spray steam directly on the fabric to be ironed, in such a way as to soften it before application of the soleplate (P).

Figure 4:
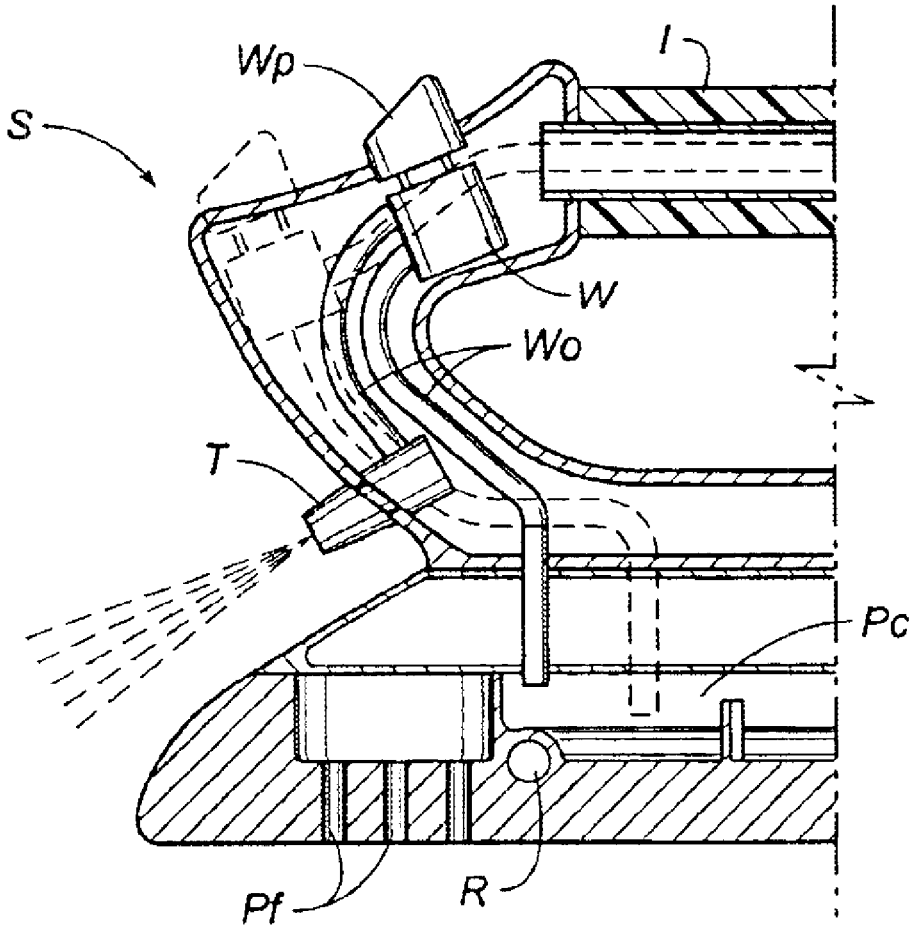
FIG. 4 is another vertical cross sectional view of a front portion of the iron.

FIG. 4 shows a further vertical cross section, in which the spray (T) is visible and highlighted. Said spray (T) is applied to the front part of the handle (I) of the iron (S) and is connected through a suitable duct (Wo) with a suitable valve (W) controlled by a button (Wp) positioned on the handle (I). A further duct (Wo) connects said valve (W) with the steam chamber (Pc) of the soleplate (P). When this button (Wp) is pressed, the pressurized steam present in the steam chamber (Pc) is conveyed towards the spray (T) and sprayed on the fabric in front of the soleplate (P).

Therefore, with reference to the above description and to the enclosed drawings, the following claims are put forth.

What is claimed is:

1. A steam iron apparatus comprising:

a boiler means for boiling water to produce steam;

a soleplate having stream outlet vents, said soleplate having a labyrinth structure thereon suitable for conveying steam to said steam outlet vents;

a steam chamber connected to said labyrinth structure, said steam chamber in communication with said boiler means such that steam passes into or is produced within said steam chamber; and a connection duct having one end opening to said steam chamber and an opposite end opening to said labyrinth structure, said connection duct having a restriction formed therein between said ends, said restriction having a diameter less than a diameter of said connection duct, said diameter of said restriction suitable for maintaining a high pressure in said steam chamber that at least partially opposes a flow of a condensate from said steam chamber toward said outlet vents.

2. The steam iron of claim 1, said connection duct having an inverted U-shape, the steam iron further comprising:

a cover affixed over said steam chamber, said connection duct passing through said cover above said steam chamber.

3. The steam iron of claim 1, said restriction in said connection duct positioned adjacent an upper portion of said steam chamber.

4. The steam iron of claim 1, further comprising:

a partition wall positioned in said steam chamber, said steam chamber having an area where water is introduced, said partition wall positioned between said area and said end of said connection duct, said partition wall having openings adjacent a top end thereof.

5. The steam iron of claim 1, further comprising:

a sprayer positioned at a front of said soleplate, said sprayer being connected to said steam chamber through ducts;

a valve means with an actuator button cooperative with said sprayer, said valve means for passing pressurized steam in said steam chamber with an actuating of said actuator button.

6. The steam iron of claim 1, said boiler means comprising:

a boiler separate from said soleplate, said boiler communicating with said steam chamber through a duct.

7. The steam iron of claim 6, further comprising:

a valve means cooperative with said duct for delivering steam toward said soleplate; and a handle connected to said soleplate and extending thereabove, said handle having a button thereon that is actuatable so as to allow steam to pass through said valve means toward said steam chamber.

8. The steam iron of claim 1, further comprising:

a pump means connected to said steam chamber for feeding water into said steam chamber.

* * * * *